United States Patent [19]

Harris

[11] 4,332,340

[45] Jun. 1, 1982

[54] PISTON TOOL BUFFER ASSEMBLY

[75] Inventor: Frederick J. Harris, Clinton, Conn.

[73] Assignee: Olin Corporation, New Haven, Conn.

[21] Appl. No.: 150,125

[22] Filed: May 15, 1980

[51] Int. Cl.[3] ..... B25C 1/14; B25C 1/18

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 2,724,116 | 11/1965 | Termet | 227/10 |
| 3,172,119 | 3/1965 | Siddons | 227/10 |
| 3,331,546 | 7/1967 | Brunelle | 227/10 |
| 3,465,942 | 9/1969 | Diehl | 227/10 |
| 3,543,986 | 12/1970 | Bakoledis et al. | 227/10 |
| 3,677,456 | 7/1972 | Ramspect et al. | 227/8 |
| 4,122,987 | 10/1972 | Jochum | 227/10 |
| 4,134,527 | 1/1979 | Termet | 227/10 |
| 4,189,081 | 2/1980 | Combette et al. | 227/10 |

*Primary Examiner*—Paul A. Bell

*Attorney, Agent, or Firm*—Paul J. Lerner

[57] ABSTRACT

A buffer assembly for use in a piston-type powder-actuated tool, which buffer assembly provides for a longer useful life of the piston. The buffer assembly includes an elastomeric member which is disposed in the bore of the tool barrel, and which is fitted with a metallic cap. The tool barrel and metallic cap combine to control and constrain radial and longitudinal expansion of the elastomeric member, when the latter is impacted by the driven piston. In this manner, extrusion of the elastomeric member is prevented and, at the same time, the piston is prevented from contacting other hardened tool surfaces.

5 Claims, 2 Drawing Figures

PISTON TOOL BUFFER ASSEMBLY

Figure 1:
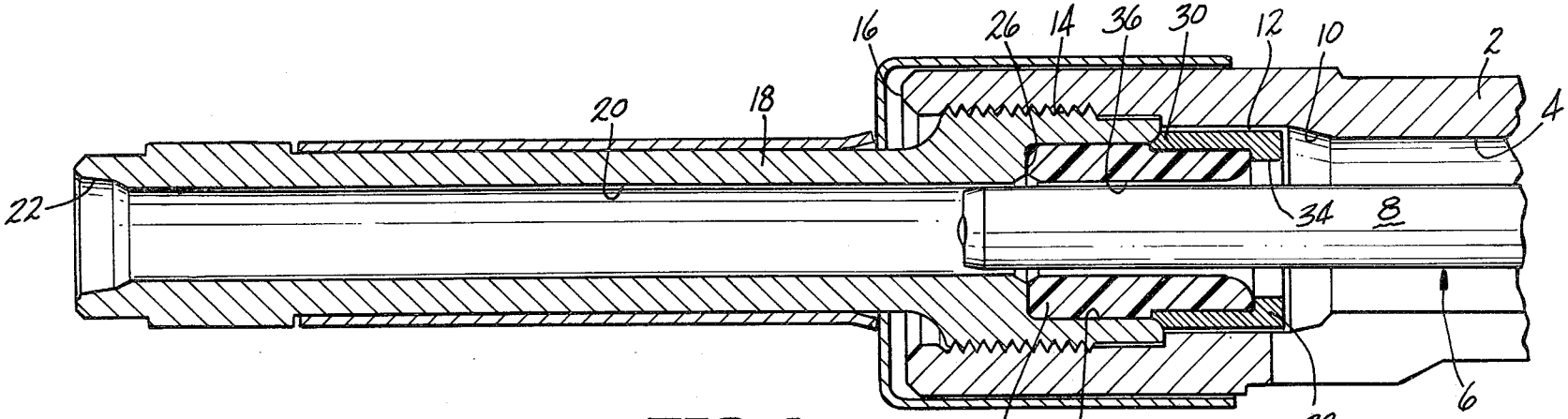

This invention relates to an improved buffer assembly for use in a piston-type powder-actuated tool. Tools of this type are used in the construction industry for driving fasteners into concrete, steel, mortar, and similar supporting surfaces. The fastener is placed in the muzzle end of the tool and a power load, typically a blank cased cartridge, is fired in a firing chamber in the tool to drive a piston against the head of the fastener, whereby the latter is embedded in the supporting surface.

To prevent or limit contact between hardened metal parts of the tool, such as the barrel, muzzle bushing, or the like, and the piston, an elastomeric member is disposed in the barrel near the muzzle for engagement with the driven piston. The elastomeric member is typically annular in configuration, and acts as a buffer to absorb piston energy and to delay stress failure of the piston, which would otherwise occur rapidly were the piston to repeatedly impact the other hardenend metal parts of the tool. Such stress failure occurs typically at the area of the piston bridging the piston shank and piston head. Even when a tool is provided with an adequate buffer member, stress failure of the piston ultimately occurs due to continued normal non-lmpact conditions causing low-cycle metal fatigue in the stressed zone of the piston.

Some typical United States patents disclosing piston tools with buffer assemblies include U.S. Pat. No. 2,724,116 to P. Termet; U.S. Pat. No. 3,172,119 to J. R. Siddons; U.S. Pat. No. 3,331,546 to L. J. Brunelle; U.S. Pat. No. 3,465,942 to K. Diehl; U.S. Pat. No. 3,543,986 to A. G. Bakoledis, et al; U.S. Pat. No. 3,677,456 to H. B. Ramspect, et al; U.S. Pat. No. 4,122,987 to P. Jochum; and U.S. Pat. No. 4,134,527 to P. Termet.

It will be apparent from a general review of the above-noted patents that the buffering effect has been produced in the past by axially compressing a cylindrical body of elastomeric material. The elastomeric body has an axial bore through which the stem of the piston passes. The cylindrical body is compressed to buffer the piston when the head of the piston strikes the end surface of the cylindrical body. This principal of compressing a cylindrical body of elastomeric material to buffer a piston has proven to be generally satisfactory when the cross-section dimensional change between the piston stem and the piston head is abrupt; however, when this change is accomplished by means of a large radius or a taper, it has been observed that the reduced or tapered area of the piston will enter the elastomeric body bore so that substantial radial deformation of the elastomeric body results, with insufficient concurrent axial compression. Thus, the buffering effect is substantially reduced, and the piston will be more apt to strike other hardened metal parts of the tool, resulting in earlier piston failure.

U.S. Pat. No. 3,465,942 to K. Diehl, mentioned above, discloses a buffer assembly which prevents the piston dimensional transition zone from entering the buffer body bore by interposing a metallic cylinder between the piston head and the buffer body. The metallic cylinder acts to convert a gradual dimensional change on the piston to an abrupt dimensional change on the cylinder, the latter of which contacts the buffer. This modification will ensure axial compression of the buffer body; however, it also results in the piston head repeatedly striking the steel cylinder, thereby causing fatigue failure of the piston and shortening effective piston life.

The buffer assembly of this invention is constructed so that when the buffer assembly is impacted by the piston, the buffer assembly expands axially rather than compresses axially. Axial expansion of the buffer assembly upon impact by the piston results in the piston being moved away from and positively prevented from striking the hardened metal parts of the tool barrel and/or muzzle bushing. In this manner, the effective life of the piston is extended. The buffer assembly of this invention includes a generally cylindrical elastomeric member, which is preferably formed from polyurethane having a hardness of 80–90 shore A durometer. The elastomeric member has an axial bore of relatively constant diameter through which the stem of the piston extends. The elastomeric member is partially contained in and confined by the tool muzzle bushing, whereby the confined portion of the elastomeric member cannot expand radially to any significant degree when an axial compressive force is applied to it upon impact by the piston. The remaining portion of the elastomeric member which is not confined by the muzzle bushing has fitted thereon and is enshrouded by a metal cap which fits tightly about the elastomeric member. The capped portion of the elastomeric member is proximal to the head end of the piston. The metal cap has an axial opening, which is larger than the diameter of the axial bore of the elastomeric member, so that the portion of the piston which is tapered or radiused to provide the transition from stem to head, can enter the axial bore of the elastomeric member. This causes the elastomeric member to try to expand radially, but since it is confined by the muzzle bushing on one hand and by the cap on the other hand, the elastomeric member must expand axially. This axial expansion continues until the outer exterior edge of the cap contacts a stop surface formed on the barrel, whereupon the elastomeric member becomes substantially non-compressible, due to its confinement by other parts of the tool. In this manner, the radiused or tapered part of the piston bridging the stem and the head is prevented from contacting metal parts of the tool, and only contacts the elastomeric member when the piston is driven.

It is therefore, an object of this invention to provide a buffer assembly for a powder-actuated piston-type tool wherein the useful life of the piston is substantially extended.

It is a further object of this invention to provide a buffer assembly of the character described which includes an elastomeric body which axially expands rather than contracts when impacted by the piston.

It is yet another object of this invention to provide a buffer assembly of the character described which positively prevents the tapered or radiused portion of the piston bridging the piston stem and piston head from contacting other hardened metal parts of the tool.

These and other objects and advantages of this invention will become more readily apparent from the following detailed description of a preferred embodiment thereof, when taken in conjunction with the accompanying drawings in which:

FIG. 1 is an axial sectional view of a portion of a powder-actuated piston-type tool, employing a buffer assembly, formed in accordance with this invention, the piston being shown fragmentally in its retired or firing position;

and

Figure 2:
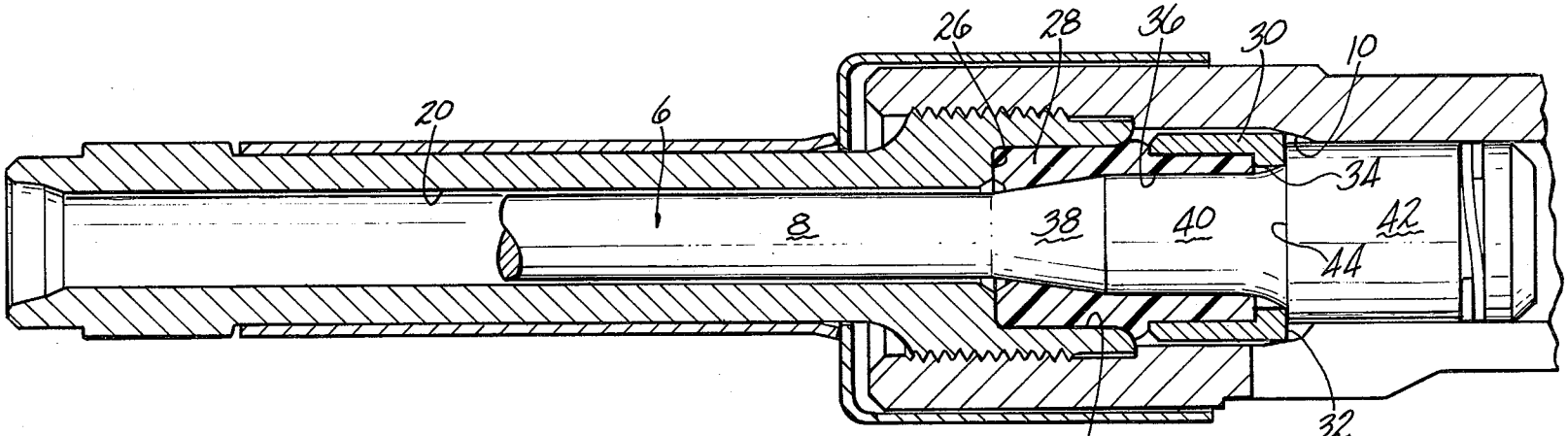

FIG. 2 is an axial sectional view similar to FIG. 1, but showing the piston in its fired position after being stopped by the buffer assembly.

Referring now to the drawings - FIG. 1 discloses the muzzleward end portion of a powder-actuated piston-type fastener driving tool, which employs the buffer assembly of this invention. The breech end of the tool wherein the firing chamber, trigger, firing mechanism, handle, and the like, are disposed, is not shown, since such portions of the tool may be of conventionally varied construction and do not form a part of this invention.

The tool includes a barrel 2 having a bore 4 in which there is reciprocally slidably disposed a piston 6. In FIG. 1 only the stem portion 8 of the piston 6 is visible. The barrel bore 4 opens muzzleward into a transitional chamfer 10 which, in turn, communicates muzzleward with a bore 12. The bore 12 communicates muzzleward with a threaded bore 14, which opens through the end 16 of the barrel 2. A muzzle bushing 18 is threaded into the bore 14 and includes a bore 20 which is coaxial with the barrel bore 4. It will be understood that the muzzle of the tool is at 22, and that fasteners to be set by the tool are inserted into the muzzle bushing bore 20 through the muzzle 22 to be impacted by the piston when the latter is driven by firing the tool. The muzzle bushing bore 20 opens breechwardly into an enlarged counter bore 24, there being a radial shoulder 26 between the muzzle bushing bore 20 and the counter bore 24, A generally cylindrical elastomeric member 28 is disposed in the counter bore 24, with the muzzleward end of the member 28 engaging the radial shoulder 26. The breechward end of the member 28 extends into the bore 12 formed in the barrel 2. That portion of the member 28 which lies within the confines of the bore 12 is fitted with a cap 30. The cap 30 is preferably steel and closely confines the side wall of the member 28, the member 28 preferably being pressfitted into the cap 30. The breechward end wall 32 of the cap 30 is provided with a through passage 34, which is substantially larger in diameter than the bore 36 through the member 28 through which bore 36 the piston stem 8 extends. For convenience in disassembly, the member 28 is preferably secured to the cap 30 by means of vulcanization, adhesive, or mechanical interlock. As is apparent in FIG. 1, the piston 6 is in its firing position and the member 28 is in an unstressed condition.

In FIG. 2, the piston 6 is shown in its fired position after it has impacted the buffer assembly. It will be noted that the piston stem 8 merges rearwardly into a zone 38 of gradually increasing diameter, the zone 38, in turn, extending to an intermediate portion 40 which is larger in diameter than the stem 8. The portion 40 extends to an enlarged diameter head 42. It will be noted that when the piston 6 is in its fired position, the zone 38 and portion 40 are driven into the bore 36 of the member 28. The forcing of these large diameter parts into the smaller diameter bore 36, combined with the radial confinement of the member 28 by the counter bore 24 and cap 30, causes the elastomeric member 28 to be drawn out over the piston 6 resulting in an increase in the overall axial dimension of the member 28. The shoulder 26 abutting the end surface of the member 28 prevents muzzleward movement of the corresponding end of the member 28, whereby the increase in axial dimension of the member 28 is realized in the breechward direction. Thus, the cap 30 is displaced breechward until it contacts the transitional chamfer 10, whereupon further axial expansion of the member 28 is prevented. Once maximum rearward expansion of the member 28 is realized, the combination of radial and axial confinement of the member 28 causes the elastomeric material to, in effect, become noncompressible as the piston 6 attempts to enter the member bore 36 still further. At maximum expansion, it will be noted that the end wall 32 of the cap 30 contacts the radial surface 44 of the piston head 42 directly. This direct contact, plus the substantial noncompressibility of the member 28 prohibits the zone 38 of the piston 6 from contacting the muzzle bushing bore 30, as will be apparent from FIG. 2. It will be further noted from FIG. 2 that the diameter of the passage 34 is large enough so that the cap 30 does not contact the piston zone 38 or portion 40, but only contacts the radial shoulder 44 of the piston head 42.

It will be readily apparent that the buffer assembly of this invention, by expanding axially rather than compressing axially when impacted by the piston, positively prohibits the increasing diameter portion of the piston, which bridges the stem and head from contacting hardened metal parts of the tool, except in the case of severe overdrive. It will also be appreciated that the buffer assembly cap will protect the elastomeric member from impinging hot combustion gases, which will deleteriously effect the elastomeric material by causing it to deteriorate by erosion. By protecting the expanding zone of the piston, the buffer assembly of this invention imparts a longer useful life to the piston.

Since many changes and variations of the disclosed embodiment of the invention may be made without departing from the inventive concept, it is not intended to limit the invention otherwise than as required by the appended claims.

What is claimed is:

1. In combination a piston buffer assembly and a powder-actuated piston-type fastener driving tool said tool having a barrel with a bore and a piston reciprocally slidably mounted in said barrel bore, said buffer assembly comprising:

(a) an annular elastomeric member disposed in said tool in a muzzleward area thereof, said elastomeric member having a bore through which a stem part of said piston extends;

(b) first means in said barrel radially and axially closely confining a muzzleward end portion of said elastomeric member;

(c) second means in said barrel closely radially confining a breechward end portion of said elastomeric member, said means allowing axial expansion of said member in a breechward direction;

(d) means for permitting a portion of said piston having a larger diameter than said stem part to enter said bore of said elastomeric member when said piston is driven in said tool whereby said elastomeric member expands only axially in a breechward direction; and (e) fixed means in said barrel bore for limiting the extent of breechward expansion of said elastomeric member.

2. In combination a piston buffer assembly and a powder-actuated piston-type fastener driving tool said tool having a barrel with a bore and a piston reciprocally slidably mounted in said barrel bore, said buffer assembly comprising:

(a) an annular elastomeric member disposed in said tool in a muzzleward area thereof, said elastomeric member having a bore through which a stem part of said piston extends;

(b) means closely radially confining said elastomeric member to substantially limit radial expansion thereof when said elastomeric member is impacted by said piston, said means further being operable to cause said elastomeric member to expand axially in a breechward direction when said elastomeric member is impacted by said piston; and (c) fixed means in said barrel bore for limiting breechward expansion of said elastomeric member when the latter is impacted by said piston to temporarily render said elastomeric member substantially non-compressible.

3. A piston buffer assembly for use in a powder-actuated piston-type fastener driving tool, said buffer assembly comprising:

(a) an annular elastomeric member having a bore which extends axially therethrough and having an outer side wall and opposed end walls;

(b) a metallic cap mounted on said elastomeric member, said cap extending axially over and closely confining at least a portion of said outer side wall of said elastomeric member, and said cap having an opening at one end thereof, said opening having a diameter which is larger than the diameter of said bore through said elastomeric member; and said cap including a radially inwardly extending end wall part at said one end of said cap, said end wall part forming said opening in said cap, and said end wall part overlying and closely confining a portion of a corresponding one of said end walls of said elastomeric member.

4. In combination with a powder-actuated piston-type fastener driving tool of the type having a barrel with a bore in which there is reciprocally slidably disposed a fastener driving piston, and having a muzzle bushing member secured to said barrel, a piston buffer assembly comprising: an annular elastomeric member disposed in said barrel bore, said elastomeric member having an axial through bore through which a stem portion of said piston extends; means in said muzzle bushing for axially and radially outwardly closely confining a muzzleward end portion of said elastomeric member; a metallic cap member mounted on a breechward end portion of said elastomeric member, said metallic cap member radially outwardly closely confining said breechward end portion of said elastomeric member; a breechward end wall of said elastomeric member being exposed for impact by a dimensionally expanding surface of said piston stem when said piston is propelled muzzleward through said barrel bore to drive a fastener whereby said elastomeric member will expand axially in a breechward direction upon being impacted by said piston surface; and means in said barrel bore to engage said cap member for limiting the extent of axial expansion of said elastomeric body.

5. The tool and piston buffer assembly of claim 4, wherein said cap includes a radially inwardly directed flange overlying an outermost part of said breechward end wall of said elastomeric member.

* * * * *